US008272591B2

(12) United States Patent
Baranov et al.

(10) Patent No.: US 8,272,591 B2
(45) Date of Patent: Sep. 25, 2012

(54) BREAKDOWN SPOOL

(75) Inventors: Fedor Baranov, East Greenbush, NY (US); Thomas Hocker, Albany, NY (US)

(73) Assignee: Sonoco, Inc., Hartsville, SC (US)

( * ) Notice: Subject to any disclaimer, the term of this patent is extended or adjusted under 35 U.S.C. 154(b) by 0 days.

(21) Appl. No.: 13/012,394

(22) Filed: Jan. 24, 2011

(65) Prior Publication Data

US 2012/0187234 A1 Jul. 26, 2012

(51) Int. Cl.
*B65H 75/14* (2006.01)
*B65H 75/22* (2006.01)

(52) U.S. Cl. ..... 242/608.5; 242/608.6; 242/608.7

(58) Field of Classification Search ..... 242/407.1, 242/607, 608, 608.1, 608.2, 608.6, 608.7, 242/610.6, 614.1, 118.6, 118.61, 6, 608.5
See application file for complete search history.

(56) References Cited

U.S. PATENT DOCUMENTS

| | | | | |
|---|---|---|---|---|
| 2,098,218 | A | | 11/1937 | Baker |
| 2,370,066 | A | | 2/1945 | Olson |
| 2,720,179 | A | | 10/1955 | Strocco et al. |
| 3,388,876 | A | | 6/1968 | Wilson |
| 3,438,592 | A | | 4/1969 | Posso |
| 3,468,492 | A | | 9/1969 | Cragg |
| 3,552,677 | A | | 1/1971 | Hacker |
| 3,635,421 | A | | 1/1972 | Boland et al. |
| 3,642,223 | A | | 2/1972 | Feichtinger |
| 3,680,809 | A | | 8/1972 | Blackmer et al. |
| 3,785,584 | A | | 1/1974 | Crellin, Jr. |
| 3,822,841 | A | | 7/1974 | Campbell |
| 4,088,278 | A | | 5/1978 | Adair |
| 4,128,215 | A | | 12/1978 | Underwood |
| 4,184,650 | A | | 1/1980 | Nelson |
| 4,371,123 | A | | 2/1983 | Watanabe |
| 4,471,919 | A | | 9/1984 | Leunig |
| 4,726,538 | A | | 2/1988 | Kovacik et al. |
| 4,880,180 | A | | 11/1989 | Adair |
| 4,903,913 | A | | 2/1990 | McCaffrey |
| 4,989,802 | A | * | 2/1991 | Akao et al. ..... 242/610.6 |
| 5,014,923 | A | | 5/1991 | Robertson |
| 5,031,854 | A | | 7/1991 | Loewe |
| 5,114,089 | A | | 5/1992 | Posso |
| 5,143,316 | A | | 9/1992 | Goetz et al. |
| 5,340,050 | A | | 8/1994 | Renck |
| 5,393,010 | A | | 2/1995 | Renck |
| 5,400,981 | A | | 3/1995 | Rambosek et al. |
| 5,415,362 | A | | 5/1995 | Lorenzo |

(Continued)

FOREIGN PATENT DOCUMENTS

DE 40 01 250 A1 7/1991

*Primary Examiner* — William E Dondero
(74) *Attorney, Agent, or Firm* — Flaster Greenberg P.C.

(57) ABSTRACT

A breakdown spool is provided having a barrel and at least one flange formed separate from the barrel. The barrel has an insertion end that includes an annular ring spaced from the axial end and projected radially from the barrel winding surface. The flange includes a receiving channel for receiving the insertion end of the barrel to form the completed spool. The receiving channel includes a first portion for receipt of the end of the barrel and a second portion for receiving the annular ring. The second portion is recessed within the support surface such that the annular ring aligns with the support surface on the flange. A locking mechanism is provided for axially securing the insertion section of the barrel within the receiving channel of the flange.

26 Claims, 11 Drawing Sheets

U.S. PATENT DOCUMENTS

| | | | |
|---|---|---|---|
| 5,575,437 | A | 11/1996 | Campbell |
| 5,593,108 | A | 1/1997 | Eck et al. |
| 5,718,397 | A | 2/1998 | Stevens |
| 5,868,348 | A | 2/1999 | Bulman |
| 5,897,075 | A | 4/1999 | Elder et al. |
| 5,931,409 | A | 8/1999 | Nulle et al. |
| 5,975,459 | A | 11/1999 | Roman |
| 6,003,807 | A | 12/1999 | Ripplinger |
| 6,036,138 | A | 3/2000 | Sexton et al. |
| 6,045,087 | A | 4/2000 | Vislocky et al. |
| 6,089,500 | A | 7/2000 | Hafner |
| 6,138,942 | A | 10/2000 | DesRosiers et al. |
| 6,234,421 | B1 | 5/2001 | Cox et al. |
| 6,257,519 | B1 | 7/2001 | Willems et al. |
| 6,398,154 | B1 | 6/2002 | Cox et al. |
| 6,588,697 | B2 | 7/2003 | Kitayama |
| 6,783,093 | B2 | 8/2004 | Limber |
| 6,874,726 | B2 | 4/2005 | Ripplinger |
| 6,991,197 | B2 | 1/2006 | Cox et al. |
| 7,073,746 | B2 | 7/2006 | Lorenzo Barroso |
| 7,222,818 | B2 | 5/2007 | Couchey et al. |
| 7,364,113 | B2 | 4/2008 | Ripplinger |
| 7,510,138 | B2 | 3/2009 | Chiorgno et al. |
| 7,534,316 | B2 | 5/2009 | Ripplinger et al. |
| 7,874,511 | B2 | 1/2011 | Chiorgno et al. |
| 2002/0148925 | A1 | 10/2002 | Cox et al. |
| 2003/0197087 | A9 | 10/2003 | Cox et al. |
| 2004/0173713 | A1 | 9/2004 | Lorenzo Barroso |
| 2005/0279877 | A1 | 12/2005 | Lorenzo Barroso |
| 2006/0086863 | A1 | 4/2006 | Couchey et al. |
| 2007/0181739 | A1 | 8/2007 | Derendal |
| 2007/0262192 | A1 | 11/2007 | Derendal |
| 2009/0261195 | A1 | 10/2009 | Chiorgno et al. |
| 2010/0025521 | A1 | 2/2010 | Snitselaar |
| 2010/0258663 | A1 | 10/2010 | Limber |
| 2011/0101153 | A1 | 5/2011 | Brennaman |

* cited by examiner

BREAKDOWN SPOOL

FIELD OF THE INVENTION

The present invention relates to a construction of a breakdown reel or spool that is used to store and transport elongated flexible materials, such as wire or cable.

BACKGROUND OF THE INVENTION

A breakdown reel or spool typically includes separate flange and barrel portions that are locked together during use and that may be separated when desired. A number of forms of breakdown spools are known.

U.S. Pat. No. 7,510,138 and US 2009/0261195 to Chiorgno et al show various breakdown spool constructions including a two-piece locking mechanism to secure the cylindrical barrel to the flange. The locking mechanism includes keyed elements that project through the wall of the flange. An inside section is engaged within the end of the barrel and includes internal structures that mate with the keyed elements on the outside section. A stop is provided on the outside wall of the inside section of the barrel. Rotation of the inside section with respect to the outside section causes a mating engagement of the keyed elements and locks the barrel and flange.

US 2007/0262192 and US 2007/0181739 to Derendal show breakdown spool constructions with outwardly projecting locking tabs on the ends of the barrel. The tabs are inserted into separate recesses within the wall of the flanges. A knob is formed on each of the locking tabs and is positioned to engage in a slot upon rotation of the barrel relative to the flange. Flexible retaining members are formed on the ends of the barrel, each with a nub extending axially outward. The nubs engage with receptacles in the surface of the flange.

U.S. Pat. No. 6,089,500 to Hafner shows a breakdown spool having a bayonet coupling between the hub and the flange. A series of retaining elements are positioned on the outside surface of the end of the barrel. The retaining elements lock with a corresponding series of inwardly projecting locking elements formed on the wall of a circular recess in the flange.

U.S. Pat. No. 3,468,492 to Cragg shows a winding spool structure with at least one flange releaseably locked to the barrel. A central hub is formed inwardly of the winding surface of the barrel. The hub includes a series of spaced lugs that engage within slots formed adjacent to a central opening in the flange. Rotation of the lugs into a locking position secures the flange to the barrel. Flexible detent members are formed in the surface of the flange. The detents engage with notches formed on the end of the barrel.

SUMMARY OF THE INVENTION

The present invention relates to a breakdown spool of the type having a barrel and at least one flange formed separate from the barrel. The barrel is defined by a longitudinal axis, a substantially annular winding surface surrounding the longitudinal axis, and an insertion section formed on at least one axial end of the barrel. In one aspect of the present invention, the insertion section includes an annular ring spaced from the axial end of the barrel and projecting radially from the winding surface. The flange includes a support surface and a receiving channel formed within the support surface. The receiving channel is provided for receiving the insertion section of the barrel to form the completed spool. The receiving channel includes a first portion for receipt of the axial end of the barrel and a second portion for receiving the annular ring of the insertion section. The second portion of the channel is recessed within the support surface such that the annular ring mates with and aligns, preferably flush, with the support surface on the flange upon insertion of the axial end of the barrel into the receiving channel. A locking mechanism is formed as part of the barrel and the flange for axially securing the insertion section of the barrel within the receiving channel of the flange.

In another aspect of the spool, the locking mechanism is formed to releasably secure the insertion section of the barrel within the first portion of the receiving channel. The locking mechanism may include at least one inwardly projected flange tab formed within the receiving channel and at least one radially outward directed barrel tab. The tabs are preferably constructed to axially overlap one another within the receiving channel to prevent axial withdraw of the barrel from the channel.

In a further aspect of the spool, the locking mechanism may include means for fixing the radial position of the barrel within the receiving channel relative to the flange. The fixing means may take the form of a flexible locking tab on the flange and a corresponding engagement means on the axial end of the barrel. The engagement means may take the form of, for example, a notch or a protrusion formed on the barrel. The barrel end is preferably rotatable within the receiving channel to a position of engagement between the flexible tab and engagement means. The flexible tab includes an engagement surface that mates with the engagement means on the barrel. A protrusion may be formed on the tab that engages with a notch on the end of the barrel. Alternatively, a receiving slot may be formed in the tab for engagement with the protrusion on the end of the barrel. The engagement between the tab and the barrel frictionally lock the radial position of the barrel relative to the flange.

The barrel is preferably integrally molded from a thermoplastic material and may include a substantially central hollow defined by an inside wall of the winding surface. Preferably, each flange is also integrally molded. Thus, the spool is preferably assembled from a minimum number of components.

In a further aspect of the flange portion of the contemplated spool, the receiving channel within the flange may include an internal support wall, positioned to fit within the portion of the central hollow at the insertion section. The internal support wall may be formed at an inwardly directed acute angle with respect to the inside wall of the barrel when the insertion section of the barrel is secured within the receiving channel. The angle of the support wall preferably creates a space between a portion of the support wall and the inside wall of the barrel. In addition, a plurality of support tabs may be formed inwardly of the support wall for structurally stiffening the support wall.

In a further aspect of the spool, the receiving channel may include an outer wall formed at an acute angle with respect to the longitudinal axis of the barrel when the insertion section of the barrel is secured within the receiving channel. The barrel also includes an extension foot directed radially outward from the insertion section adjacent the axial end. The foot portion is located on the barrel axially outward of the annular ring. The foot preferably engages the outer wall of the receiving channel when the insertion end of the barrel is secured within the receiving channel. The fixing means portion of the locking mechanism may be formed at least partially within the foot on the barrel end, with the foot forming the notch for receipt of the protrusion on the end of the flexible tab.

In a further aspect of the spool, a plurality of spaced extension feet are provided, with each foot preferably forming a radial projection on the outer surface of the axial end of the barrel. Each extension foot projection is contemplated to fit within the space created by the projections within the receiving channel. Upon radial rotation of the barrel within the receiving channel, the projections and protrusions are contemplated to overlap, axially locking the barrel within the receiving channel.

Other features of the present invention and combinations of features will become apparent from the detailed description to follow, taken in conjunction with the accompanying drawings.

BRIEF DESCRIPTION OF THE DRAWINGS

For the purpose of illustrating the invention, the drawings show forms that are presently preferred. It should be understood that the invention is not limited to the precise arrangements and instrumentalities shown in the drawings.

DETAILED DESCRIPTION

Figure 1:
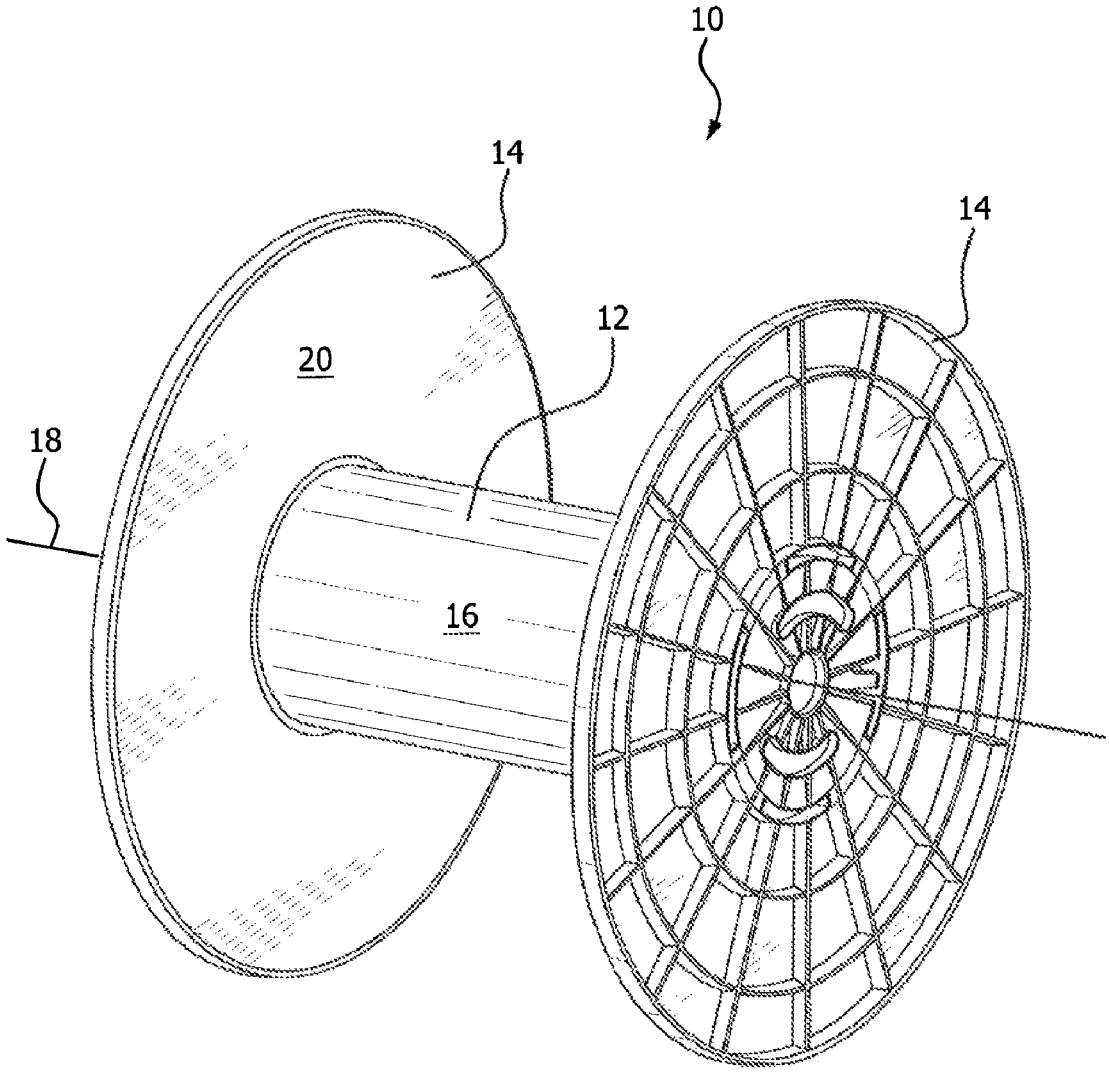
FIG. 1 shows a perspective view of an embodiment of a spool having features contemplated by the present idea.

In the figures, where like numerals identify like elements, there is shown an embodiment of a breakdown spool designated by the numeral 10. As generally shown in FIG. 1, the spool 10 is comprised of a barrel 12 and one or more flanges 14. Two flanges 14 are shown in the figures, although a functional winding spool may include only a single flange if desired. The barrel 12 as shown is defined by an annular winding surface 16, which is generally formed about a longitudinal axis 18. The flanges 14 include a support surface 20 directed inwardly towards the winding surface 16 of the barrel 12. The winding surface 16 and the support surface(s) 20 form engagement surfaces for the elongate material (not shown) to be wound on the spool 10.

Figure 2:
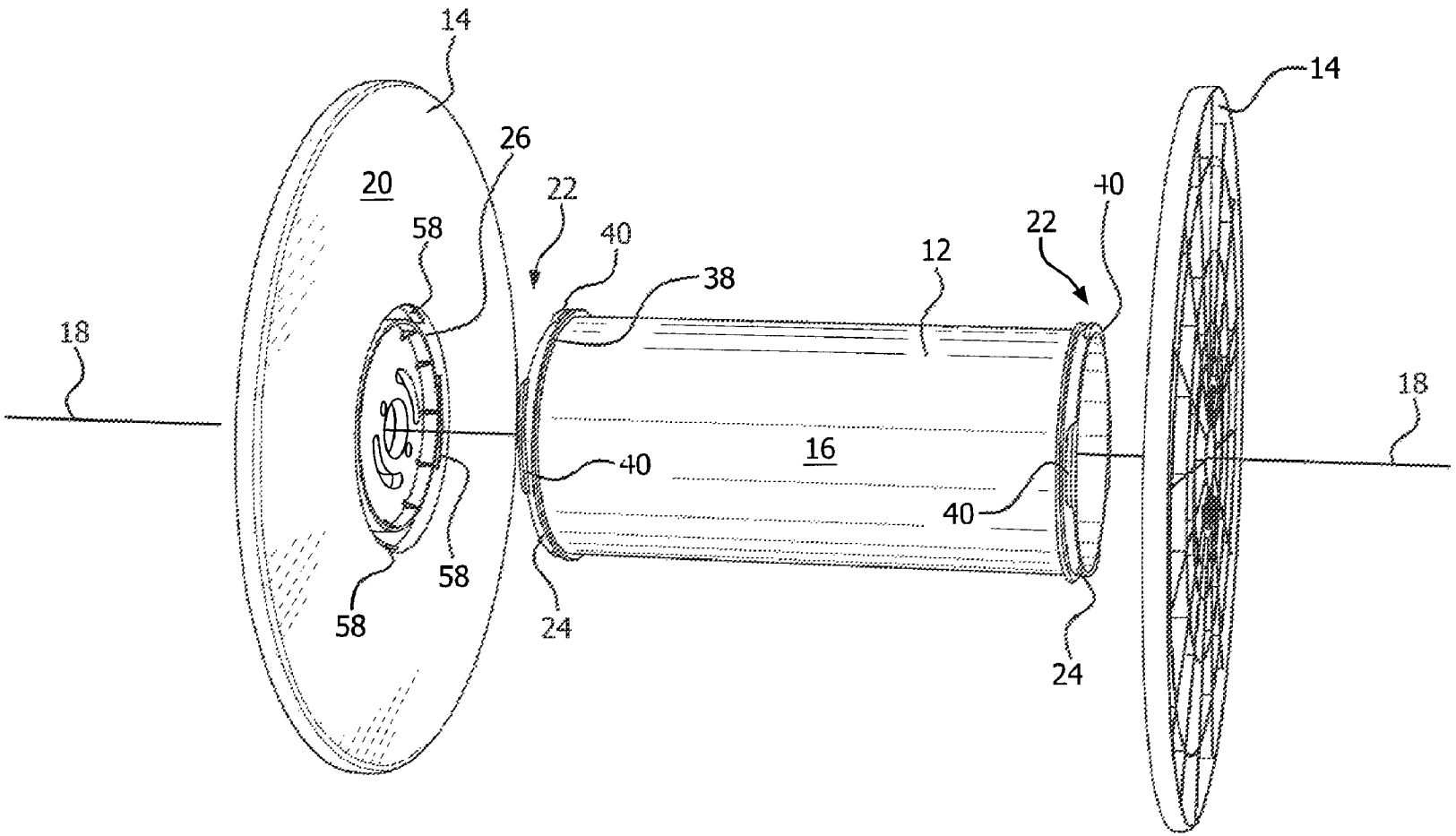
FIG. 2 shows an exploded perspective view of the spool of FIG. 1.

In FIG. 2, the spool 10 is shown with its constituent parts being separated. As illustrated, the barrel 12 includes an insertion section 22 on each longitudinal end 24. Formed within the support surface 20 of each flange 14 is a receiving channel 26 having a generally circular form. The connection of one of the flanges to one end of the barrel is described below. It should be understood that in the preferred two flange construction, each flange will be formed in a similar fashion, as will each end of the barrel. In addition, the barrel structure is contemplated to be integrally molded. Similarly, the structure of the flange preferably has an integrally molded construction.

Figure 3:
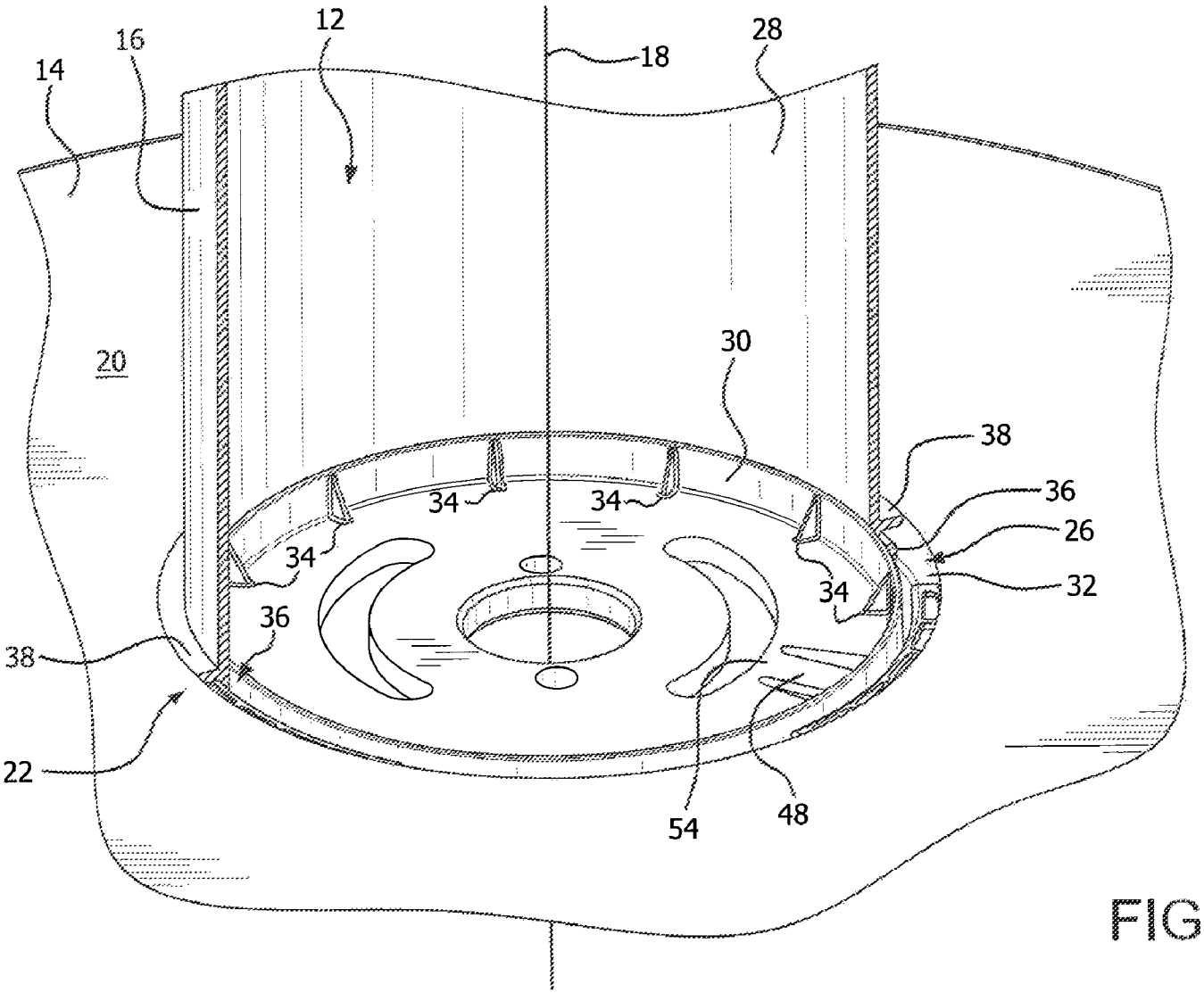
FIG. 3 shows a partial cross sectional view of a portion of the spool of FIGS. 1 and 2.

In FIG. 3, there is shown the interaction of the insertion section 22 on the axial end 24 of the barrel 12 with the receiving channel 26 of the flange 14. The barrel 12 is shown in section with the winding surface 16 directed radially outward and surrounding the longitudinal axis 18. The inner portions of the barrel 12 define a cylindrical central hollow having an inner wall 28 that is preferably cylindrical. The circular channel 26 as shown includes an inner support wall 30 that is spaced radially inward from an outer wall 32. As detailed further below, the space between the inner wall 30 and the outer wall 32 is formed to receive the insertion section 22 of the axial end 24 of the barrel 12. Stiffening ribs 34 are provided radially inward of the inner wall 30, with the remaining portion of the recess being open. As shown on the rear portion of the flange (opposite of the support surface), a plurality of ribs are provided to strengthen the flange. In addition, various holes or openings are provided in the wall of the central portion of the flange. These openings may provide for engagement by a drive means for the spool and gripping holes for handling the spool during use and assembly.

The insertion section 22 of the barrel 12 includes an axial end portion 36 and an annular ring 38 that projects radially outward from the winding surface 16 of the barrel 12. The axial end portion 36 fits within the channel 26 and is positioned between the inner support wall 30 and the outer wall 32. The annual ring 38 is spaced from the axial end 36 of the barrel 12 and mates with support surface 20 of the flange 14.

Figure 4:
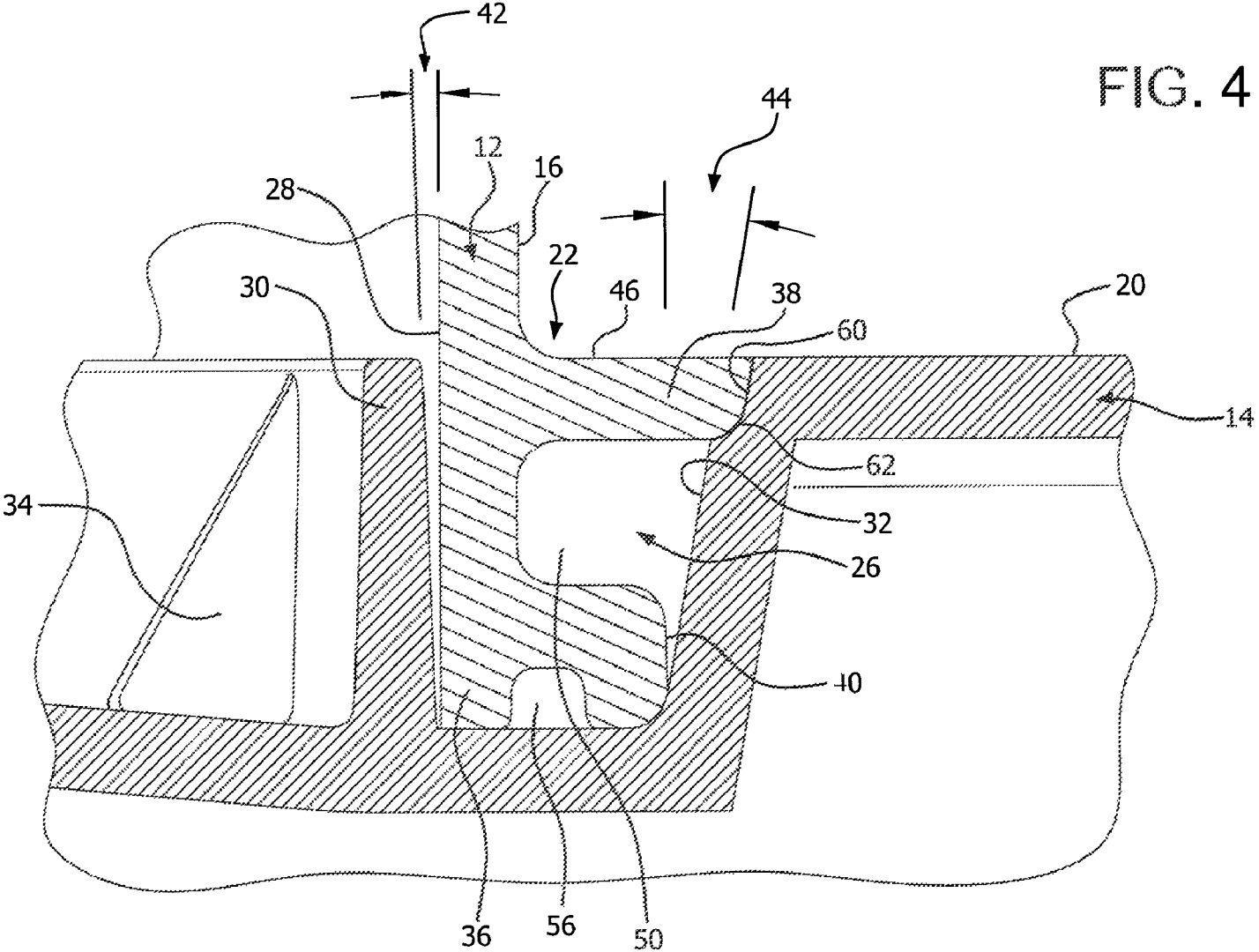
FIG. 4 shows a cross sectional view of a portion of the connection between the flange and barrel of the spool of FIGS. 1-4.

A cross sectional view of the relative positioning of the insertion section 22 of the barrel 12 within the receiving channel 26 is shown in FIG. 4. The axial end 36 of the insertion section 22 is positioned within the channel 26 between the inner support wall 30 and the outer wall 32. An outwardly directed barrel tab or foot 40 is formed on the axial end 36 and projects from the barrel surface 16. As shown in FIG. 2, multiple feet 40 are provided around the circumference of the end of the barrel 12. Each foot 40 is provided at a spaced location.

As shown in FIG. 4, a space is preferably provided between the inner support wall 30 and the inner wall 28 of the barrel 12. This space is created in part by the inward tapering 42 of the inner support wall 30 relative to the inner barrel wall 28, which is preferably parallel to and concentric with the longitudinal axis 18. The outer wall 32 of the receiving channel 26 as shown is angled 44 relative to the barrel wall 16 and thus the longitudinal axis 18 of the barrel 12. The angle 44 of the outer wall 32 may be in the range of 10 to 15 degrees, relative to a line parallel to the longitudinal axis (18), and may be greater than the taper 42 of the inner support wall 30.

The radial projection of the ring 38 is contemplated to be greater than the projection of the foot 40 from the barrel surface 16. The top surface 46 of the ring 38 is aligned to be flush with the support surface 20 of the flange 14, creating a continuous surface. The projected tip 60 of the ring 38 conforms to a receiving edge 62 of the outer wall 32 of the receiving channel 26. The mating of the ring tip 60 with the receiving edge 62 provides axial support for the ring 38. Below the ring 38 is created an engagement space 50. In the cross section of FIG. 4, the engagement space 50 is further refined by the position of the projecting foot 40.

Figure 5:
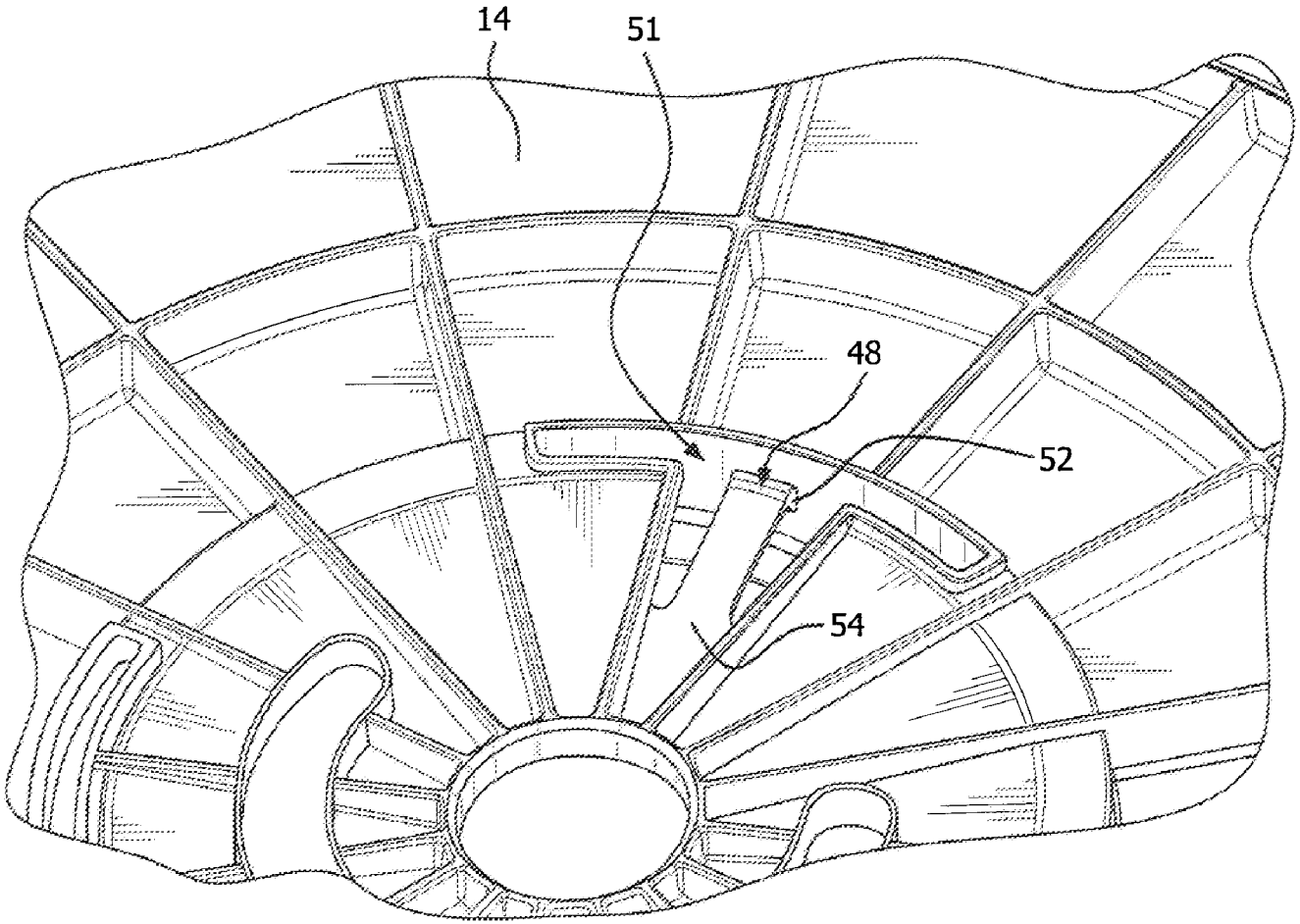
FIG. 5 shows a partial perspective view of an outside surface of a flange portion of the spool of FIGS. 1-3.

In FIG. 5, there is shown a locking tab 48 formed as part of the body of the flange 14. The locking tab 48 is formed within an opening 51 within the wall of the flange 14. The tab 48 is cantilevered from a fixed base 54 and contemplated to be flexible, such that a head portion 52 is moveable away from the normal plane of the tab 48. The tab 48 forms a portion of the locking mechanism for the barrel 12 and flange 14 by engaging means within the end of the barrel 12 to fix the radial position of the barrel 12 within the receiving channel 26.

Figure 6:
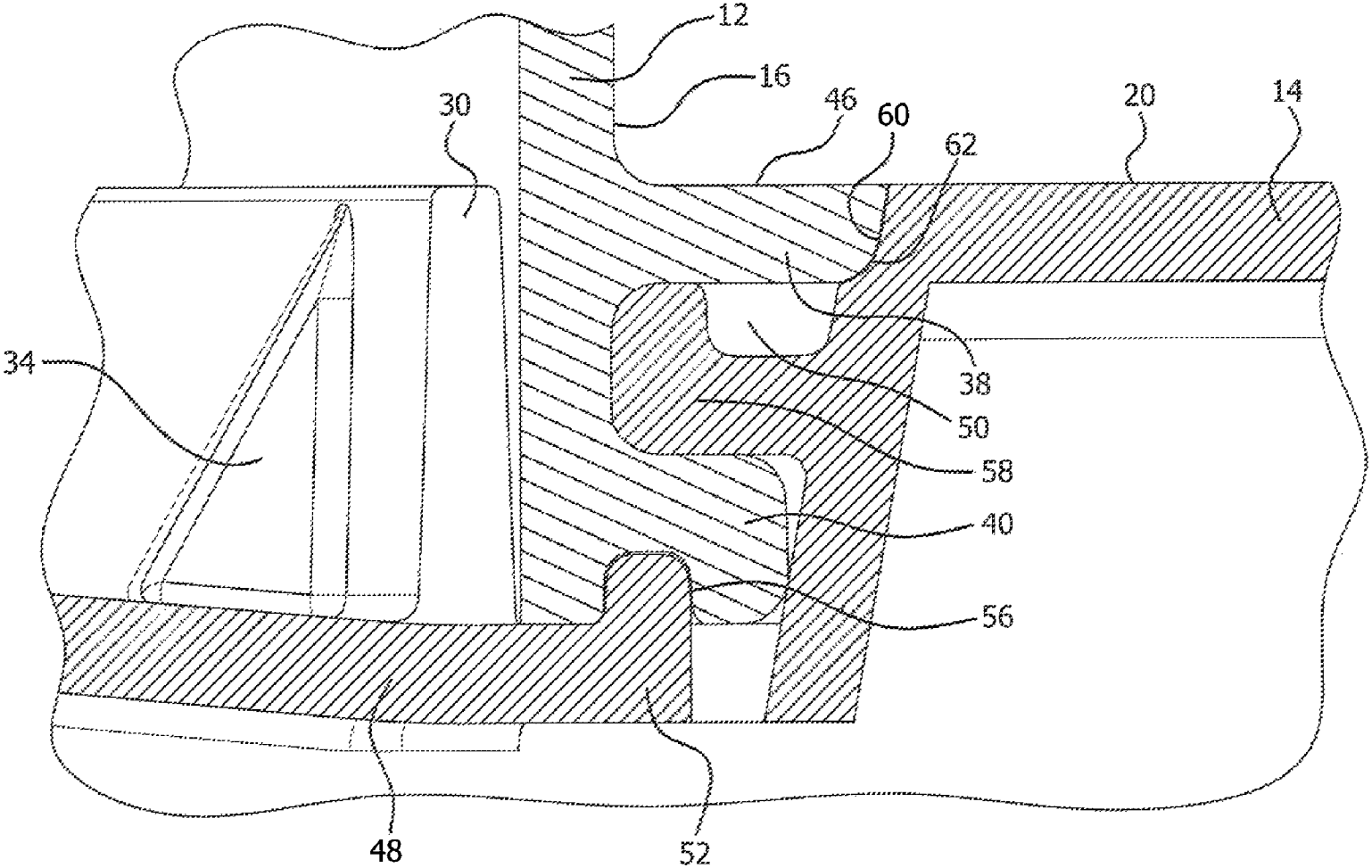
FIG. 6 shows a cross sectional view at a different radial location than that taken in FIG. 5, with the present view showing a further portion of the connection between the flange and barrel portions of the spool of FIGS. 1-4.

In FIG. 6, the tab 48 is shown in cross section with the head portion 52 engaged within a notch 56 formed on the bottom surface of a foot 40 on the end of the barrel 12. The notch 56 is contemplated to have defined sidewalls (not shown) such that the tab head 52 is engaged on all sides. The engagement of the head 52 of the tab 48 within the notch 56 on the foot portion 40, resulting from the spring force of the tab 48 and the shape of the head portion 52 and notch 56, preferably resists rotational movement between the barrel 12 and the flange 14.

As shown in FIG. 6, a radially inward protrusion or flange tab 58 is formed on the outer wall 32 of the receiving channel 26. The flange tab 58 fits within the space 50 (see also FIG. 4) between the ring 38 and the foot 40 on the axial end 36 of the barrel 12. The combination of foot 40 and tab 58 forms a part of the locking mechanism for the barrel 12 and the flange 14. The overlap of the foot 40 with the tab member 58 of the insertion section 22 within the channel 26 axially secures the barrel 12 with the flange 14.

As shown in the exploded view of FIG. 2, a number of inwardly directed tabs 58 are formed within the channel 26. The tabs 58 are contemplated to be equidistantly spaced around the outer wall 32 in the channel 26. The barrel 12 is provided with a corresponding number of feet 40 that are also spaced around the perimeter of the axial end 36 of the barrel. The spacing is contemplated to permit the barrel insertion section 22 to be axially inserted into the channel 26, with the tabs 58 and feet 40 alternating within the channel 26. A radial rotation of the barrel 12 relative to the flange 14 causes each individual foot 40 to move under a corresponding tab 58 to axial lock the flange 14 to the barrel 12. The surfaces of the tabs 58 and feet 40 may be sized and formed to create a frictional engagement as part of the overlapping relationship. This frictional locking of the tabs 58 within the engagement space 50 further secure the barrel 12 and flange 14 together, resisting a radial rotation of the parts. The fixing means formed by the flexible tab 48 engagement with the notch 56 in the foot 40 further secures the radial position of the barrel 12 within the channel 26 of the flange 14. A single locking tab 48 is provided on the flange 12 and is positioned within the area of the receiving channel 26 between two of the inwardly directed tabs 58.

The locking mechanism between the flange 14 and the barrel is preferably releasable. The flexibility of the tab 48 permits the head portion 52 to move away from its engagement position within the notch 56, allowing the relative rotation of the flange 14 and the barrel 12, until the rotation causes the feet 40 to move into the area adjacent the spaced tabs 58 within the channel 26. Once the barrel feet 40 are no longer overlapping with the tabs 58, the insertion end 22 of the barrel 12 may be axially withdrawn from the channel 26 and separated from the flange 14.

The spool 10 as illustrated and described is an efficient assembly of two to three pieces and creates a bond between the barrel 12 and the flange(s) 14 that is strong enough to meet or exceed industry strength requirements. The assembly is created by rotating the barrel 12 relative to the flange(s) 14. The two parts are further locked into place by the engagement of the elements of the barrel insertion section 22 and the structures within the receiving channel 26. The locking tab 48 engagement of the barrel axial end 36 may further be released for breakdown of the spool elements. Movement of the tab 48 is dependant on the flexibility of the tab. It is contemplated that disassembly may include the breaking of the tab to permit rotation and release.

The corner defined by intersection of the winding surface of the barrel and the support surface of the flange often creates a stress concentration within known spool constructions. The stress due to normal use (and disuse) may further cause unintended failure of the assembly (or molded parts). Material fatigue in the area of the barrel/flange intersection may result in damage to the material wound on the spool or cause a snag in the winding (and unwinding) operation. In the embodiments shown, a fillet is provided at the intersection of the ring 38 and the winding surface 16 of the barrel 12. The radial extension of the ring 30 forms a start-up for the flange support surface 20 and separates the stress, which may be caused by deflection of the flange 14, from the intersection with the barrel wall 14. The angle 44 of the outer wall 32 may also serve to diminish stress concentrations. The support of the end 60 of the ring 38 by the receiving surface 62 on the flange serves to diminish stress on the ring 38. Further, the dimensional relationships of the engagement of the insertion section 22 of the barrel 12 with the receiving channel 26 of the flange preferably fix the barrel and flange to form a relatively rigid spool construction.

Figure 7:
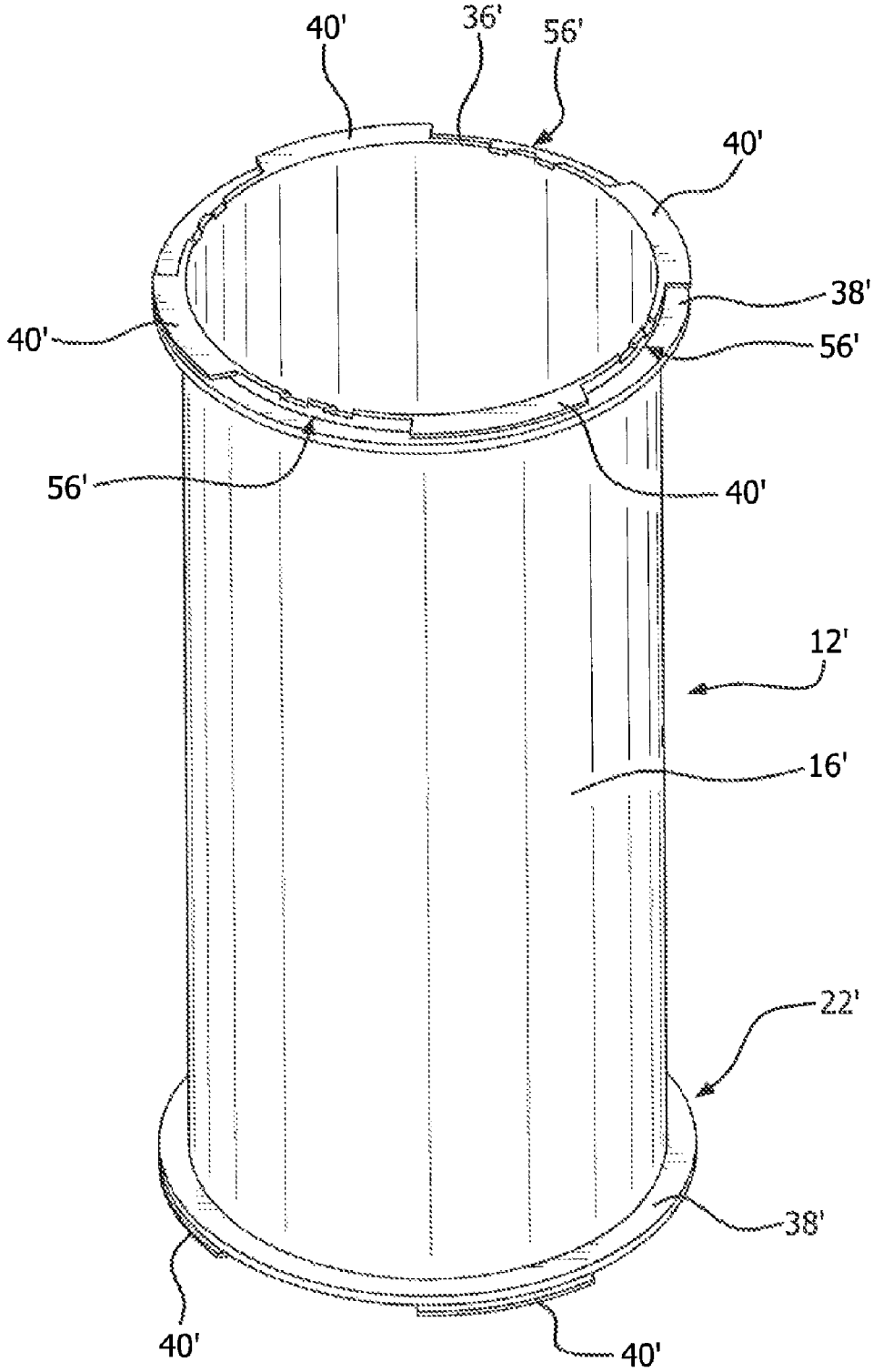
FIG. 7 shows a perspective view of an embodiment of a barrel portion of a spool.

In FIGS. 7-11, there is shown a barrel and flange combination having some different structural features from those shown in the prior figures. In FIG. 7, a barrel 12' is shown having a cylindrical winding surface 16' and an insertion section 22' on each end. The insertion section 22' is defined by an annular ring 38 spaced from an axial end 36' of the barrel 12' and a plurality of projection feet 40 around the perimeter of the axial end 36'. On the axial end 36' of the barrel, between adjacent feet 40', is provided a plurality of engagement means 56'. As more particularly shown in FIG. 8, the engagement means 56' is formed by a projection 64 positioned between two cutouts 66 within the axial end 36' of the barrel 12'. The engagement means 56' engages with additional structures on the flange (see FIGS. 9-11, discussed below) to fix the radial position of the barrel 12', when locked to the flange.

Figure 8:
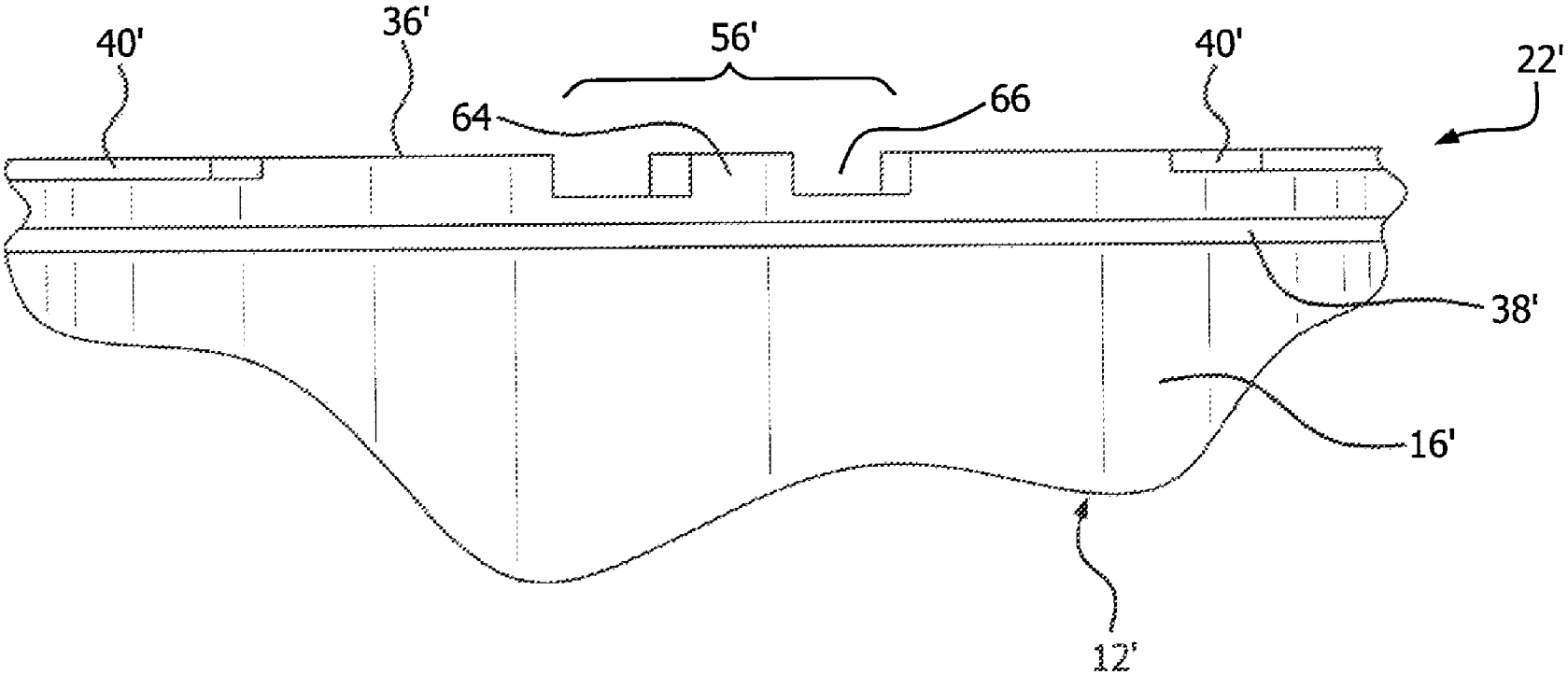
FIG. 8 shows an enlarged elevation view of a portion of an end of the barrel shown in FIG. 7.
Figure 9:
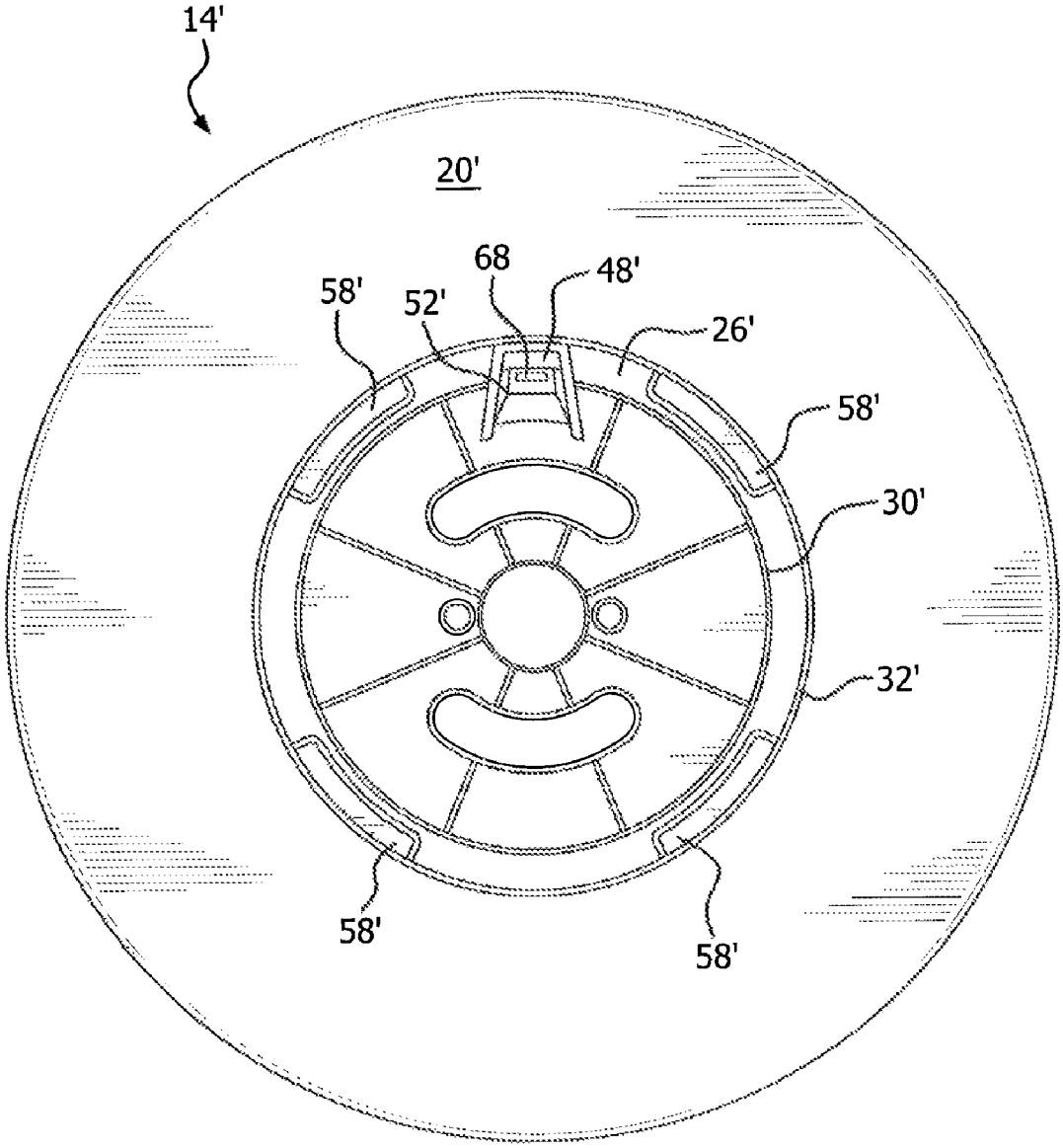
FIG. 9 shows a plan view of an embodiment of a flange portion of a spool, the flange contemplated to mate with the barrel shown in FIGS. 7 and 8.

In FIG. 9, there is shown one face of a flange 14' having a support surface 20' surrounding a receiving channel 26' for the insertion section 22' of the barrel 12' of FIGS. 7 and 8. The receiving channel 26' is similar to that of FIGS. 1-6, having an inner support wall 30', an outer wall 32 and a plurality of inwardly projecting tabs 58' spaced around the defined channel 26'. A flexible tab 48' is defined in the flange 14' and is positioned between two locking tabs 58'. The head 52' of the flexible tab 48' includes an opening 68 formed to engage a projection 64 on the axial end 36' of the barrel 12'.

Figure 10:
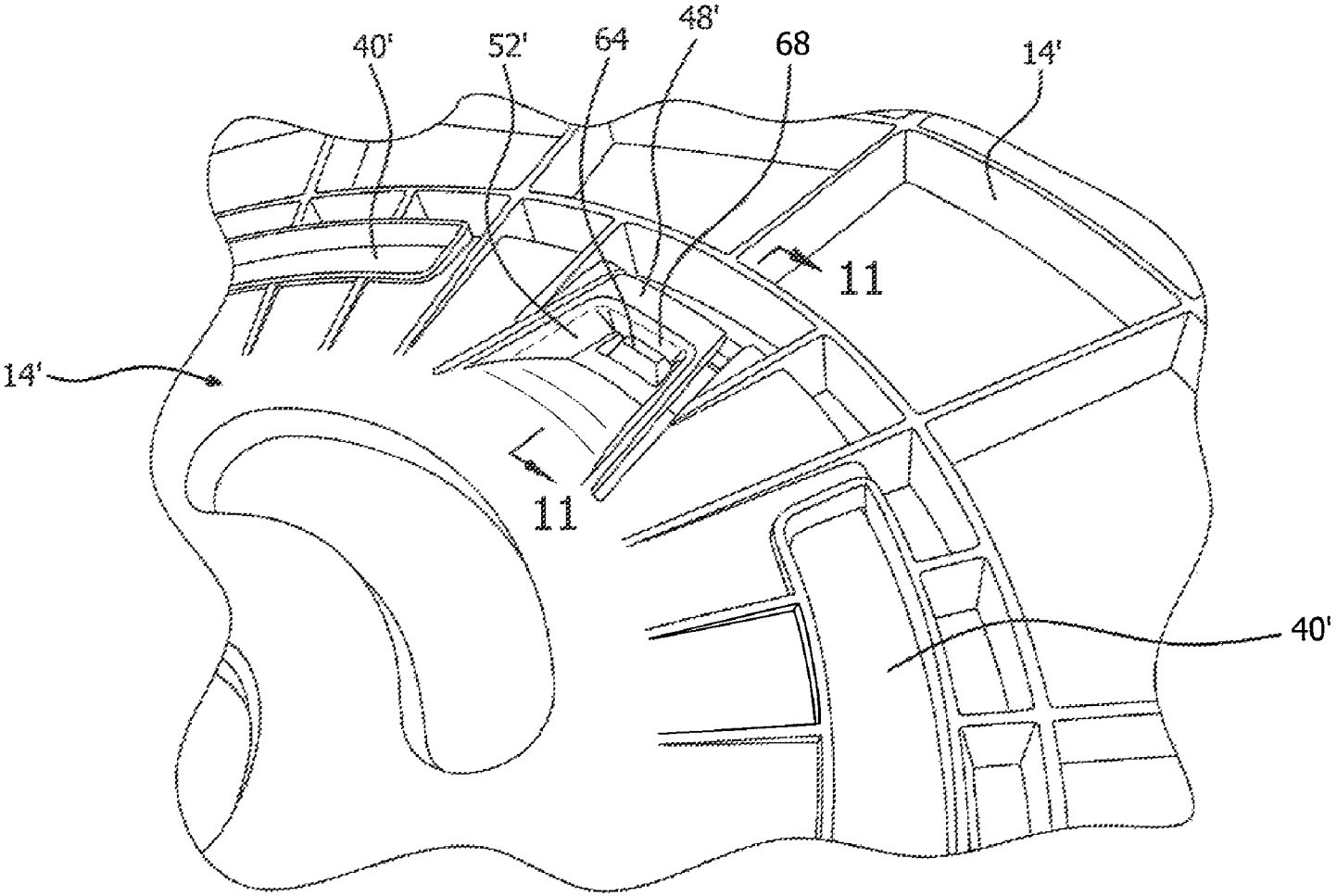
FIG. 10 shows a partial perspective view of the flange shown in FIG. 9.

In FIG. 10, a portion of the flange 14' is shown engaged with an end of the barrel 12' of FIGS. 7 and 8. The flexible tab 48' includes an opening 68 and is aligned within the receiving channel 26' in the space between two of the inwardly projecting tabs 58'. As the barrel end (36') is rotated within the receiving channel 26', the feet 40' rotate into the space between the bottom of the channel 26' and the inwardly projecting tabs 58'. The overlap of the feet 40' and the inward projections 58' within the channel serve as an axial locking mechanism for the barrel 12' and flange 14'. In the view of FIG. 10, two of the feet 40' are shown within openings formed in the body of the flange 14'. Further locking of the barrel 12' and flange 14' occurs during the relative rotation of the barrel 12' and flange 14'. One of the projections 64 on the axial end 36' of the barrel 12' (FIGS. 7 and 8) moves into contact with the flexible tab 48'. The tab 48' flexes to permit the projection 64 to move into alignment with the opening 68. Once aligned, the projection 64 is engaged within the opening 68 and the radial position of the barrel 12' and the flange 14' is fixed.

Figure 11:
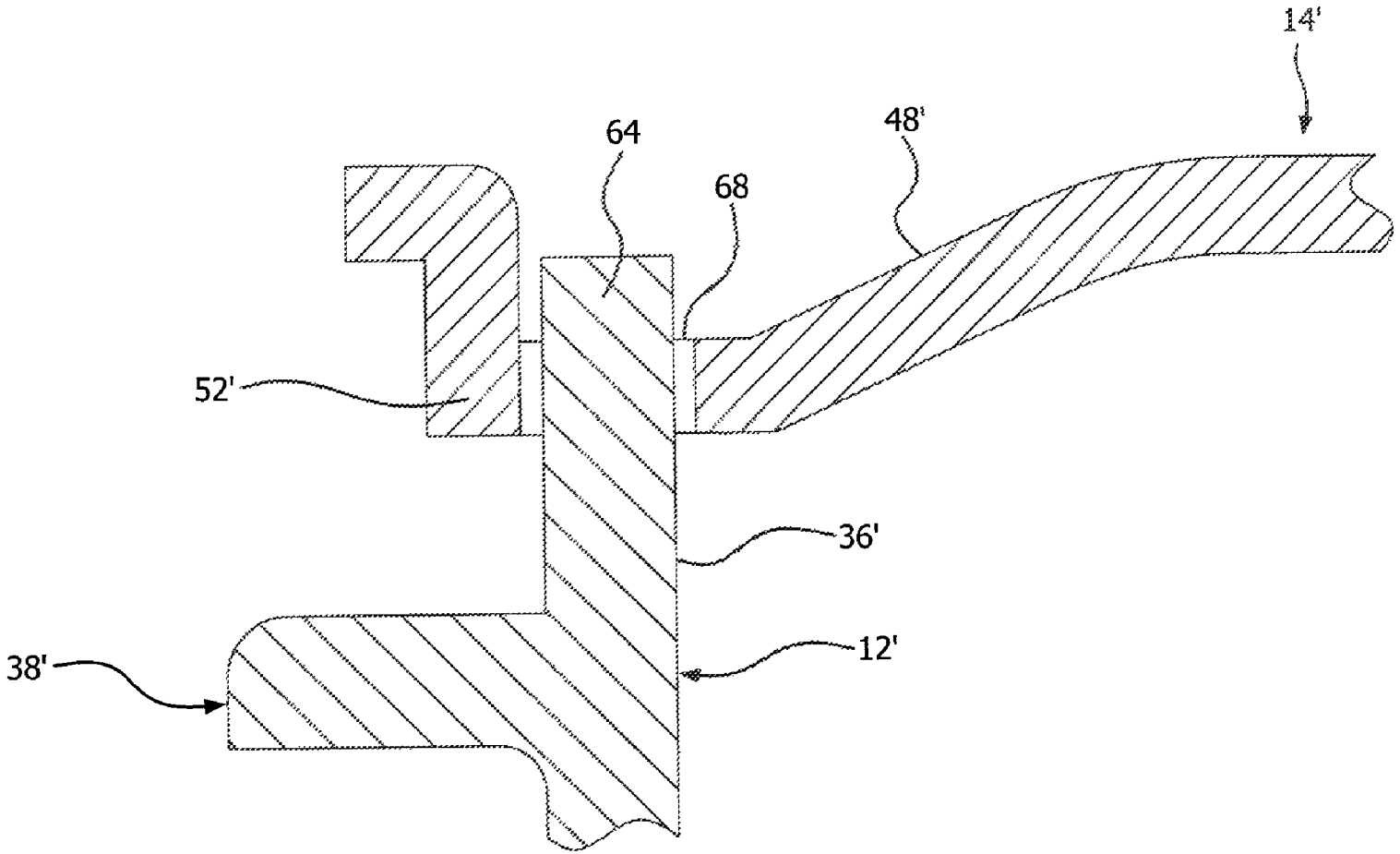
FIG. 11 shows a cross sectional view of a portion of the flange of FIGS. 8 and 9, as taken along line 11-11.

The engagement of the flexible tab 48' on the flange 14' with the projection 64 on the axial end 36' of the barrel 12' is shown in FIG. 11. The two cutouts 66 (see FIG. 8) permit the tab 48' to flex to its normal position, once the projection 64 is positioned within the opening 68 on the end of the tab 48'. The ring 38' is spaced from the flexible tab 48'. Although there are some differences in structure in the present embodiment, the end of the ring 38' is contemplated to engage and align flush with the support surface of the flange in the manner shown in FIGS. 4 and 6. In addition, in the present embodiment a fillet is shown at the intersection of the ring 38' and the barrel wall, as is also discussed above.

It is preferred that the structures of the present invention be formed with a minimum number of parts. Thus, the completed spool is shown in FIGS. 1 and 2 to have a single barrel part and two flange parts. The spool parts are also contemplated to be injection molded from a thermoplastic material, such as styrene, an olefin or combination of polymer materials. Further, the structures of the barrel are preferably integrally molded. Each flange part is also integrally molded. The surfaces and structural elements of the molded parts are preferably arranged to allow for withdraw of the mold sections from the parts with a minimum of movements and mold sections.

The present invention has been described and illustrated with respect to a number of exemplary embodiments thereof. It should be understood by those skilled in the art from the foregoing that various other changes, omissions and additions may be made therein, without departing from the spirit and scope of the present invention, with the scope of the present invention being described by the foregoing claims.

What is claimed is:

1. A breakdown spool comprising:

a barrel having a longitudinal axis, a substantially annular winding surface surrounding the longitudinal axis, and an insertion section formed on at least one axial end of the barrel, the insertion section comprising an annular ring spaced from the axial end and projecting radially from the winding surface;

at least one flange having a support surface, and a receiving channel formed within the support surface, the receiving channel for receiving the insertion section of the barrel, the receiving channel comprising a first portion for receipt of the axial end of the barrel, and a second portion for receiving the annular ring of the insertion section, the second portion recessed within the support surface such that the annular ring mates and aligns with the support surface on the flange upon insertion of the axial end of the barrel into the first portion of the receiving channel;

a locking mechanism formed as part of the barrel and the flange for axially securing the insertion section of the barrel within the receiving channel of the flange; and means for releasably fixing the radial position of the barrel within the receiving channel relative to the flange, the fixing means having a radially inwardly extending locking tab formed on the flange, the flange being resiliently flexible for axial movement, and a notch formed on the axial end of the barrel, the barrel end being rotatable within the receiving channel to a position of axial engagement between the flexible tab and the notch, the engagement of the tab with the notch fixing the radial position of the barrel within the receiving channel.

2. A breakdown spool as in claim 1, wherein the locking mechanism releasably secures the insertion section of the barrel within the first portion of the receiving channel.

3. A breakdown spool as in claim 1, wherein the locking mechanism comprises at least one inwardly projected flange tab formed within the receiving channel and at least one radially outward directed barrel tab, the tabs positionable to overlap within the receiving channel and to prevent axial withdraw of the barrel from the receiving channel.

4. A breakdown spool as in claim 1, wherein the locking mechanism comprises an inside section and an outside section defining a protrusion and a receptacle, the protrusion and receptacle frictionally engaging one another within the receiving channel to removably secure the axial and radial position of the barrel relative to the flange.

5. A breakdown spool as in claim 1, wherein the barrel is integrally molded from a thermoplastic material.

6. A breakdown spool as in claim 1, wherein the barrel comprises a substantially central hollow defined by an inside wall of the winding surface.

7. A breakdown spool as in claim 6, wherein the receiving channel further comprises an internal support wall, positioned to fit within the portion of the central hollow at the insertion section.

8. A breakdown spool as in claim 7, wherein the internal support wall is formed at an inwardly directed acute angle with respect to the inside wall of the barrel when the insertion section of the barrel is secured within the receiving channel, the angle creating a space between a portion of the support wall and the inside wall of the barrel.

9. A breakdown spool as in claim 7, further comprising a plurality of support tabs formed inwardly of the support wall for structurally stiffening the support wall.

10. A breakdown spool as in claim 7, wherein the receiving channel further comprises an outer wall formed at an acute angle with respect to the longitudinal axis of the barrel when the insertion section of the barrel is secured within the receiving channel.

11. A breakdown spool as in claim 10, wherein the barrel further comprises an extension foot directed radially outward from the insertion section adjacent the axial end, axially outward of the annular ring, the extension foot engaging the outer wall of the receiving channel when the insertion end of the barrel is secured within the receiving channel.

12. A breakdown spool as in claim 11, wherein the locking mechanism comprises an inside section and an outside section, the inside and outside sections defining a protrusion and a receptacle, the protrusion and receptacle frictionally engaging one another within the receiving channel to removably secure the axial and radial position of the barrel relative to the flange.

13. A breakdown spool as in claim 12, wherein the extension foot and annular ring form the inside portion receptacle.

14. A breakdown spool as in claim 13, wherein the outside protrusion section is formed on the outer wall and engages the receptacle channel formed by the extension foot and the annular ring.

15. A breakdown spool as in claim 14, wherein the extension foot comprises a plurality of spaced projections that project radially outward from the axial end of the barrel.

16. A breakdown spool as in claim 15, wherein the outside protrusion comprises a plurality of spaced matching projections, the extension foot projections configured to fit within the spacing of the matching projections on insertion of the barrel into the receiving channel, and upon rotation of the barrel within the receiving channel axially securing the barrel within the receiving channel.

17. A breakdown spool as claimed in claim 1 wherein the locking tab comprises a projected head portion, the head portion having an opening therein, and wherein the notch on the axial end of the barrel comprises a central axially outward projection, the notch formed to receive the head portion of the locking tab with the axial projection positioned within the opening within the head portion, the rotation of the axial end of the barrel within the receiving channel to a position of engagement between the head portion and the notch and axial projection and the opening radially fixes the position of the barrel.

18. A breakdown spool as claimed in claim 17 wherein the locking tab is formed in an opening in the flange and the head portion projects into the receiving channel.

19. A breakdown spool comprising:

an integrally formed barrel having a longitudinal axis, a substantially annular winding surface surrounding the longitudinal axis and defining an internal hollow having a substantially cylindrical inside surface, and an insertion section formed on each axial end of the barrel, the insertion section comprising a plurality of radially projecting feet, the feet spaced around the perimeter of the axial end of the barrel, and an annular ring spaced from the axial end and projecting radially from the winding surface;

two flange members, for attachment to the axial ends of the barrel, each flange member having a support surface, a receiving channel formed within the support surface, the receiving channel for receiving the insertion section of the barrel, the receiving channel comprising a first portion for receipt of the axial end of the barrel, the first portion having an internal support for engagement within the cylindrical surface of the hollow of the barrel, an outwardly angled wall combining with the internal support wall an opening for receipt of the insertion section, and a plurality of inwardly directed protrusions formed on the angled wall, the protrusions being spaced from one another in a complimentary pattern to the projecting feet on the insertion end of the barrel, and a second portion for receiving the annular ring of the insertion section, the second portion recessed within the support surface such that the annular ring mates with the angled wall of the first portion and aligns flush with the support surface on the flange upon insertion of the axial end of the barrel into the first portion of the receiving channel, wherein the spaced feet and space protrusions form a releasable locking mechanism upon insertion of the barrel into the receiving channel and a rotation of the flange relative to the barrel to form an axial overlap of the feet and protrusions, the overlap of the locking mechanism axially securing the insertion section of the barrel within the receiving channel of the flange; and means for releasably fixing the radial position of the barrel within the receiving channel relative to the flange, the fixing means having a radially inwardly directed flexible locking tab formed on each of the flanges and a corresponding notch formed on the axial ends of the barrel, each barrel end being rotatable within the receiving channel of one of the flanges to a position of axial engagement between the flexible tab and the notch, the engagement of the tab with the notch fixing the radial position of the barrel within the receiving channel.

20. A breakdown spool as in claim 19, wherein each protrusion frictionally engages the corresponding foot member to secure the radial position of the barrel insertion end within the receiving channel of the flange.

21. A breakdown spool as claimed in claim 19 wherein the locking tab comprises a projected head portion, the head portion having an opening therein, and wherein the notch on the axial end of the barrel comprises a central axially outward projection, the notch formed to receive the head portion of the locking tab with the axial projection positioned within the opening within the head portion, the rotation of the axial end of the barrel within the receiving channel to a position of engagement between the head portion and the notch and axial projection and the opening radially fixes the position of the barrel.

22. A breakdown spool as claimed in claim 21 wherein the locking tab is formed in an opening in the flange and the head portion projects into the receiving channel.

23. A breakdown spool comprising:

an integrally formed barrel having a longitudinal axis, a substantially cylindrical winding surface surrounding the longitudinal axis, opposing axial ends of the barrel, and an annular insertion section formed on at least one axial end of the barrel, the insertion section comprising an annular ring spaced axially inward from the axial end and projecting radially outward from the winding surface; and at least one, integrally formed flange member having a substantially planar support surface, an annular receiving channel offset from the planar support surface, the receiving channel formed for receiving the insertion section of the barrel, the receiving channel comprising a first portion for receipt of the axial end of the barrel, and a second portion for receiving the annular ring of the insertion section, the second portion recessed within the support surface such that the annular ring mates and aligns with the support surface on the flange upon insertion of the axial end of the barrel into the first portion of the receiving channel;

a locking mechanism formed as part of the barrel and the flange for axially securing the insertion section of the barrel within the receiving channel of the flange;

a flexible locking tab integrally formed on the flange and extending radially inward, the locking tab having a radially projected head portion, the head portion having an opening therein; and a notch formed on the axial end of the barrel, the notch defining an axially extending projection therein, the notch formed to receive the head portion of the locking tab with the axial projection positioned within the opening of the head portion, wherein the barrel end is rotatable within the receiving channel to a position of engagement between the head portion and the notch and axial projection and the opening to radially fix the position of the barrel within the receiving channel upon engagement of the locking mechanism.

24. A breakdown spool comprising:

a barrel having a longitudinal axis, a substantially cylindrical winding surface surrounding the longitudinal axis, opposing axial ends of the barrel, and an annular insertion section formed on at least one axial end of the barrel;

at least one flange having a substantially planar support surface, an annular receiving channel offset from the planar support surface, the receiving channel formed for receiving the insertion section of the barrel;

a locking mechanism formed as part of the barrel and the flange for axially securing the insertion section of the barrel within the receiving channel of the flange;

a radially inwardly extending flexible locking tab formed on the flange and aligned with the receiving channel, the locking tab having a projected head portion, the head portion having an opening therein; and a notch formed on the axial end of the barrel, the notch defining a central axially outward projection, the notch formed to receive the head portion of the locking tab with the axial projection positioned within the opening within the head portion, wherein the barrel end is rotatable within the receiving channel to a position of engagement between the head portion and the notch and axial projection and the opening to radially fix the position of the barrel within the receiving channel upon engagement of the locking mechanism.

25. A breakdown spool as claimed in claim 24 wherein the insertion section of the barrel comprises an annular ring spaced axially from the axial end and projecting radially outward from the winding surface.

26. A breakdown spool as claimed in claim 25 wherein the receiving channel further comprises:

a first portion for receipt of the axial end of the barrel, and a second portion for receiving the annular ring of the insertion section, the second portion recessed within the support surface such that the annular ring mates and aligns with the support surface on the flange upon insertion of the axial end of the barrel into the first portion of the receiving channel.

* * * * *